US005318175A

United States Patent [19]

Stevens

[11] Patent Number: 5,318,175

[45] Date of Patent: Jun. 7, 1994

[54] SUPPORT RACK FOR CLOTHES AND OTHER ARTICLES

[76] Inventor: Brian J. Stevens, 161 Hazelwood Crescent, Winnipeg, Manitoba, R2M 4E4, Canada

[21] Appl. No.: 913,379

[22] Filed: Jul. 15, 1992

[51] Int. Cl.[5] ..... A47F 5/00

[52] U.S. Cl. ..... 211/86; 211/196; 211/205

[58] Field of Search ..... 211/86, 196, 205, 189, 211/194; 223/95, 88; 248/218.4

[56] References Cited

U.S. PATENT DOCUMENTS

| | | | |
|---|---|---|---|
| 1,038,198 | 9/1912 | Randall et al. | 211/205 |
| 1,710,711 | 4/1929 | Patterson | 211/87 X |
| 2,903,227 | 9/1959 | Key . | |
| 2,941,669 | 6/1960 | Palay et al. . | |
| 3,035,708 | 5/1962 | Freeman . | |
| 3,085,691 | 4/1963 | Smith | 211/86 |
| 3,101,291 | 8/1963 | Labick | 248/538 X |
| 3,197,034 | 7/1965 | Deadrich | 211/205 |
| 3,291,434 | 6/1965 | Whitechester . | |
| 3,310,180 | 3/1967 | Neagle | 211/205 |
| 3,421,762 | 1/1969 | Paradise | 248/538 X |
| 4,101,036 | 7/1978 | Craig . | |
| 4,468,421 | 8/1984 | Wang | 211/205 X |
| 4,534,471 | 8/1985 | Zahn et al. | 211/163 |
| 4,770,303 | 9/1988 | Boyd | 211/205 |
| 4,819,817 | 4/1989 | Mar | 211/205 |
| 4,838,625 | 6/1989 | Taylor . | |
| 4,889,246 | 12/1989 | Lee | 211/205 X |
| 5,127,528 | 7/1992 | Cone | 211/163 X |

FOREIGN PATENT DOCUMENTS

| | | | |
|---|---|---|---|
| 2019457 | 11/1971 | Fed. Rep. of Germany | 211/205 |
| 2109456 | 11/1971 | Fed. Rep. of Germany | 211/205 |
| 602492 | of 1925 | France | 211/205 |

*Primary Examiner*—David A. Scherbel
*Assistant Examiner*—Korie H. Chan
*Attorney, Agent, or Firm*—Adrian D. Battison; Stanley G. Ade; Murray E. Thrift

[57] ABSTRACT

A support rack for temporary storage of clothes and other articles comprises a post with a bottom ring member for resting on the floor and a top pad member spring biased upwardly for engaging the ceiling of a room so the post is supported vertically by its engagement with the floor and the ceiling. The post is formed from from elongate post portions and from separate support pieces, each of which has a coupling at the top and bottom ends for engagement with respective post portions. Each support piece includes 3 pins projecting upwardly and outwardly at 90° spacing with each pin being arranged to receive a sleeve of a support member for the articles. One support member comprises a trouser bar with a triangular loop at the top of the sleeve and a second support member comprises a tray.

5 Claims, 3 Drawing Sheets

SUPPORT RACK FOR CLOTHES AND OTHER ARTICLES

BACKGROUND OF THE INVENTION

This invention relates to a support rack for temporary storage of clothes and other articles within a room.

At nighttime when a person is removing clothing and taking out from the clothing the normal everyday articles such as keys, money, wallets and the like, it is often difficult to place the articles, that is the clothing and the other elements in a suitable storage position. Not many people are sufficiently disciplined to hang up their clothing within the closet and therefore clothing is often left draped on chairs or even the floor with the risk of becoming severely wrinkled. Other articles such as keys are often placed down without thought as to their location add are accordingly difficult to find in the morning.

It is one object of this invention therefore to provide a temporary storage rack which is simply positioned in the bedroom at a location where the person can readily access the rack and can place the various articles including clothing and other items onto the rack for temporary storage. This provides therefore a much more attractive and organized appearance and also enables the various articles to be properly located so they are readily available to be found in the morning.

Various proposals have been made for display racks which are positioned in a room so as to extend from the floor to the ceiling and be supported by the frictional engagement between the elongate vertical post portion, the floor and the ceiling. Examples are shown in U.S. Pat. Nos. 3,035,708 (Freeman), 4,838,625 (Taylor), 4,101,036 (Craig), 2,941,669 (Palay), 3,291,434 (Whitechester) and 2,903,227 (DeKalb). Each of these devices is designed for displaying items in a store and is therefore not in any way proposed for use in a bedroom location. Various attachment devices are provided for displaying various elements such as hats, various articles of clothing and the like. However, these devices are constructed of generally elongate metal elements which are very utilitarian in appearance and are intended for relatively rigid structure suitable for commercial use and therefore are unattractive in a bedroom situation, are relatively expensive and provide elements on structural strength which is not required for the bedroom situation. Furthermore, the devices are difficult to transport and therefore are difficult to retail to the average home user.

SUMMARY OF THE INVENTION

According to the invention, therefore, there is provided a support rack for temporary storage of clothes and other articles within a room comprising a post member having an upper pad for engaging a ceiling of the room, a lower floor engagement member for engaging the floor, spring means between the post member and the upper pad so as to bias the pad into engagement with the ceiling for support of the post member solely by engagement with the ceiling and the floor, and a plurality of support elements mounted on the post member for engaging and supporting the clothing and other articles, the post member comprising a plurality of molded plastic support pieces each having a plurality of separate receptacles thereon, each receptacle arranged for receiving thereon a respective one of said plurality of support elements for ready removal from and attachment to the receptacle, a plurality of elongate post portions, each said support piece having an upper coupling portion and a lower coupling portion each receiving an end of a respective one of said post portions in axially aligned position with said support pieces spaced by at least one post portion.

One embodiment of the invention now being described in conjunction with the acompanying drawings in which:

DESCRIPTION OF THE DRAWINGS

In the drawings like characters of reference indicate corresponding parts of the different figures.

DETAILED DESCRIPTION

Figure 1:
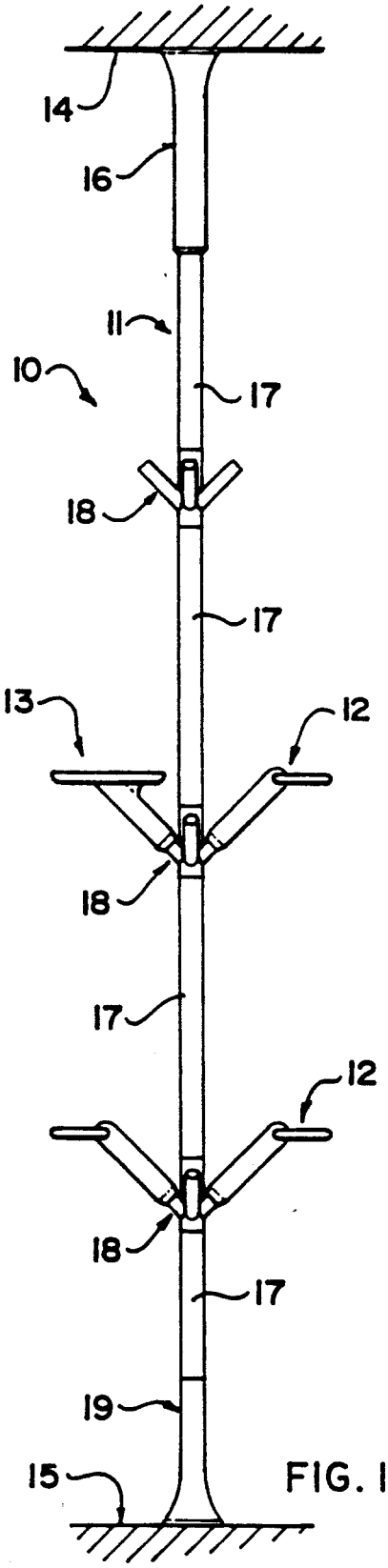
FIG. 1 is a side elevational view of the storage rack according to present invention.

A storage rack is generally indicated at 10 in FIG. 1 and is comprised generally of a post member 11 together with a plurality of support members 12 and 13 which are mounted on the support post member 11.

The post member 11 is formed of a plurality of individual portions which are connected together in coaxial end to end relationship to form the complete post extending from a ceiling 14 to a floor 15 of a room within which the rack is to be mounted.

The post member comprises an upper ceiling abutment portion 16, a plurality of post portions 17, a plurality of support pieces 18 and a floor abutment portion 19.

The pieces can be disassembled as explained hereinafter and transported or supplied in a collapsed condition in suitable packaging of relatively small dimensions and then can be simply assembled by connection end to end to a required length and mounted into place supported wholly between the floor and the ceiling without necessity for further support connections.

Figure 2:
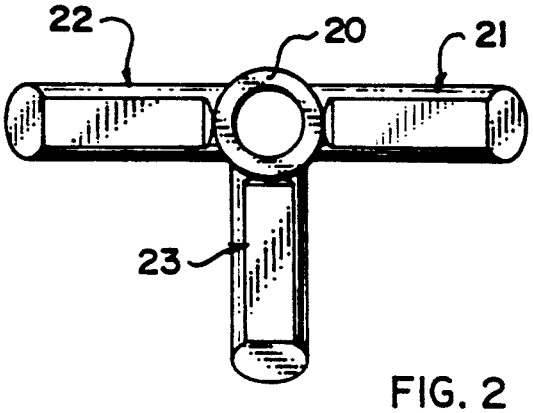
FIG. 2 is a top plan view of one support piece forming a part of the rack of FIG. 1.
Figure 3:
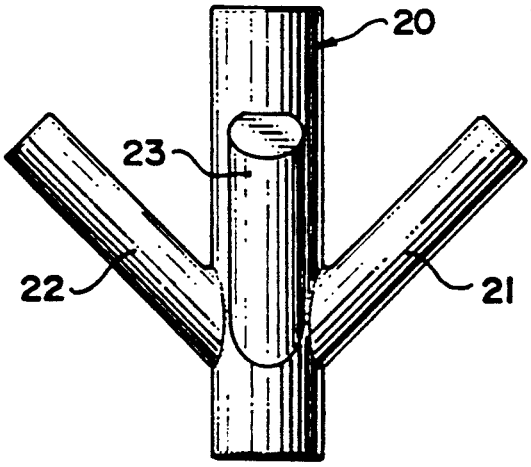
FIG. 3 is a side elevational view of the support piece of FIG. 2.
Figure 4:
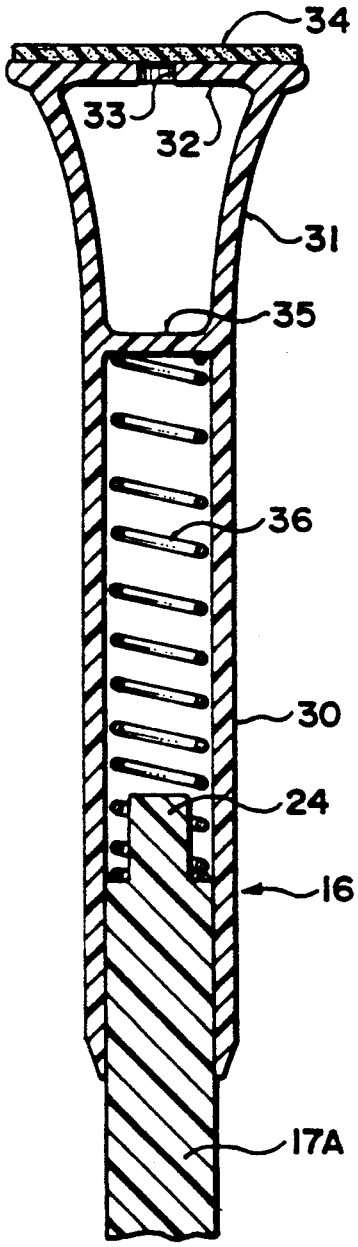
FIG. 4 is a cross-sectional view through an upper part of the rack of FIG. 1.
Figure 6:
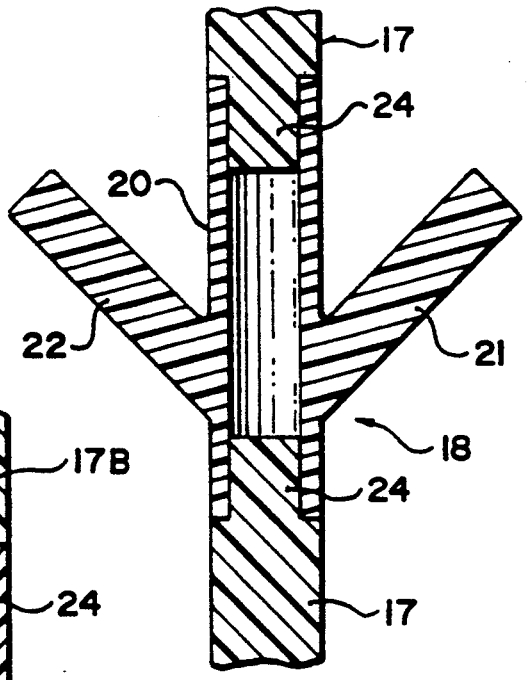
FIG. 6 is a cross-sectional view through a centre part of the rack of FIG. 1 showing a support piece of FIGS. 2 and 3.
Figure 5:
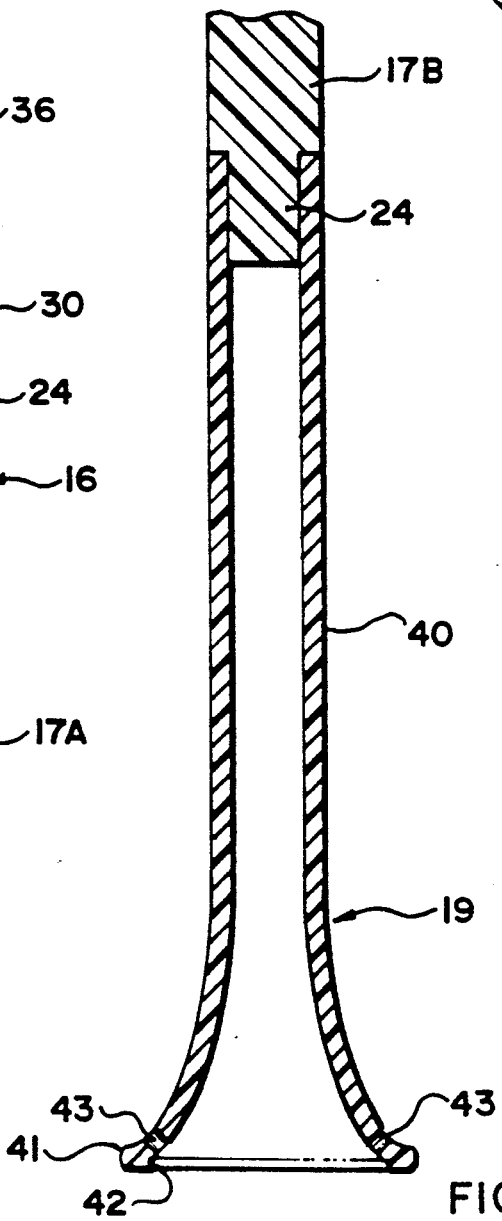
FIG. 5 is a cross-sectional view through a lower part of the rack of FIG. 1.

One of the support pieces is shown in FIGS. 2, 3 and 6, and this comprises an integrally injection molded body form from a plastics material defining a sleeve 20 and three arms or pins 21, 22 and 23 which are mounted on the outside surface of the sleeve and project upwardly and outwardly therefrom at an angle of the order of 45°. The pins 21, 22 and 23 are positioned at 90° spacing so they project outwardly to the sides and forwardly allowing the device to be positioned adjacent to a wall if required. Each of the pins is formed with a flat top surface with the pin otherwise cylindrical thus forming a flat to prevent rotation of a corresponding shaped sleeve when mounted on the respective pin.

The length of the sleeve is arranged to be such as to extend just beyond the top and bottom of the pins just to provide enough length for connection to a respective one of the post portions 17.

The post portions 17 comprise a cylindrical body having an outside diameter substantially equal to the outside diameter of the sleeve 20 and a pin portion 24 at an end of the post portion dimension to insert as a friction fit within the interior of the sleeve 20. The post portions and the support pieces can therefore be connected readily together in the axially aligned arrangement. The number of support pieces can be varied in accordance with requirements simply by selecting a particular length of the post portions or by providing coupling elements in the form simply of a sleeve. The length of the support piece allows it to be readily injection molded as a single integral element.

A top one 17A of the post portions projects into an interior of the ceiling abutment member 16 which includes a sleeve 30 of an inside diameter to just receive as a sliding fit the outside surface of the post portion 17A. The abutment member 16 includes a cylindrical sleeve portion 30 together with an upper frusto conical portion 31 which diverges outwardly to an end or top plate 32 which has a central hole 33. On top of the top plate 32 can be provided a resilient pad 34 if required for abutment adjacent a rough or stippled ceiling.

The bottom abutment member 19 arranged for abutting the floor 15 comprises a sleeve 40 which flairs outwardly at the lower end to a rim 41 surrounding an open lower end 42. The pin portion 24 of a bottom one 17B of the post portions projects into the interior of the sleeve 40 as a friction fit. The outside diameter of the sleeve 40 is equal to the outside diameter of the post portion so as to provide a smooth outer appearance. The open end face 42 can rest over a carpet surface with the pile of the carpet being received inside the open end face. If it is placed on a flat or plain floor surface, the attachment can be supplemented by screws passed through screw openings 43 although this generally is used only on a commercial installation where more rigidity is required.

Between the upper end of the top post portion 17A and the underside of a cross web 35 is provided a spring 36 which biases the upper abutment member upwardly into frictional engagement with the ceiling. For installation however the sleeve 30 can be grasped and pulled downwardly to reduce the length of the post allowing the upper pad 34 to be positioned against the ceiling when the sleeve is then released this allows the spring to push the pad 34 upwardly against the ceiling.

Figure 8:
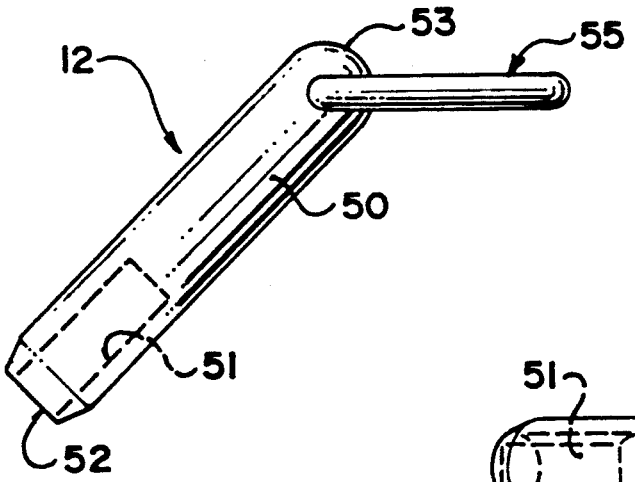
FIG. 8 is a side elevational view of the trouser bar of FIG. 7.
Figure 7:
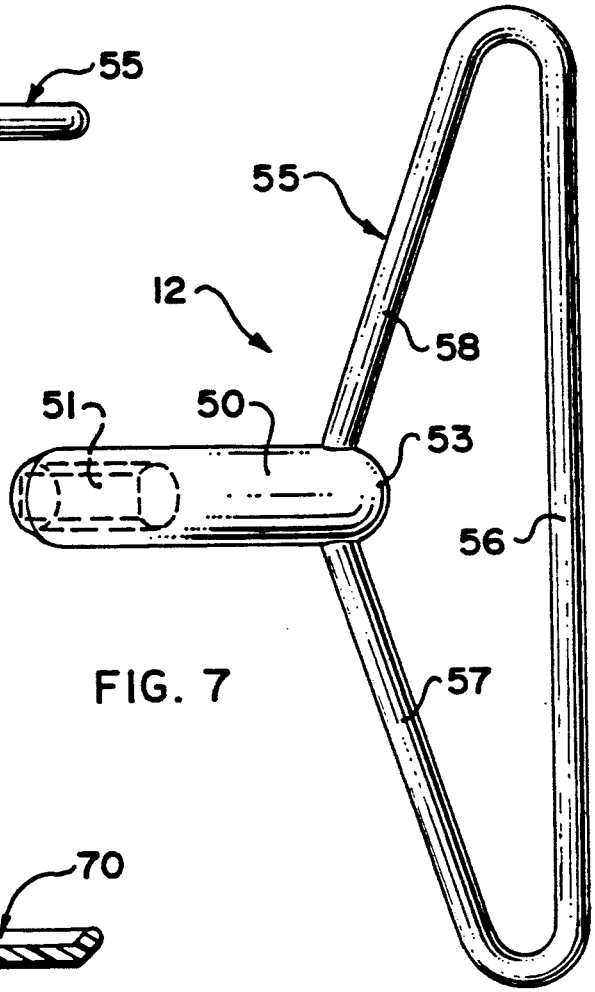
FIG. 7 is a top plan view of the trouser bar support of the rack of FIG. 1.

In FIGS. 7 and 8 is shown a trouser bar support for attachment over one of the pins of the support pieces. The trouser bar thus includes a stub shaft portion 50 with an internal opening 51 breaking out on an end 52 defining the sleeve for pressing over a respective one of the pins of the support pieces. The recess 51 is shaped as a cylinder with a flat, that is as exactly corresponding to the shape of the pin so that the pin can be readily received as a friction fit and the stub shaft 50 is prevented from twisting. The stub shaft is arranged thus coaxially with the respective pin and extends upwardly and outwardly from the post to an upper end 53 at which is attached a triangular shaped bar member 55. The bar member includes a horizontal trouser bar 56 which is arranged at right angles to a vertical plane containing the axis of the stub shaft portion 50. The bar 56 is spaced outwardly from the end 53 and is supported at that position by a pair of bar portions 57 and 58 forming the triangular shape, the portions 57 and 58 projecting outwardly to respective sides. As shown in FIG. 8 the bar portion is arranged in a horizontal plane. The trouser bar can therefore be used to support trousers, jackets, shirts or the like with the trousers being inserted through the bar in conventional manner and suspended over the bar 56. Jackets can be wrapped around with the shoulders within the ends of the bar 56.

Figure 10:
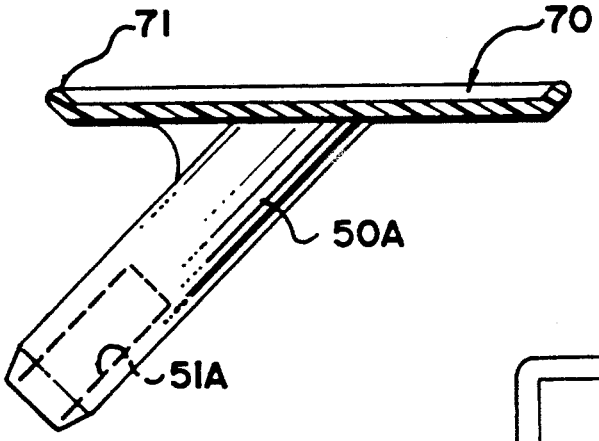
FIG. 10 is a vertical cross section through the tray of FIG. 9.
Figure 9:
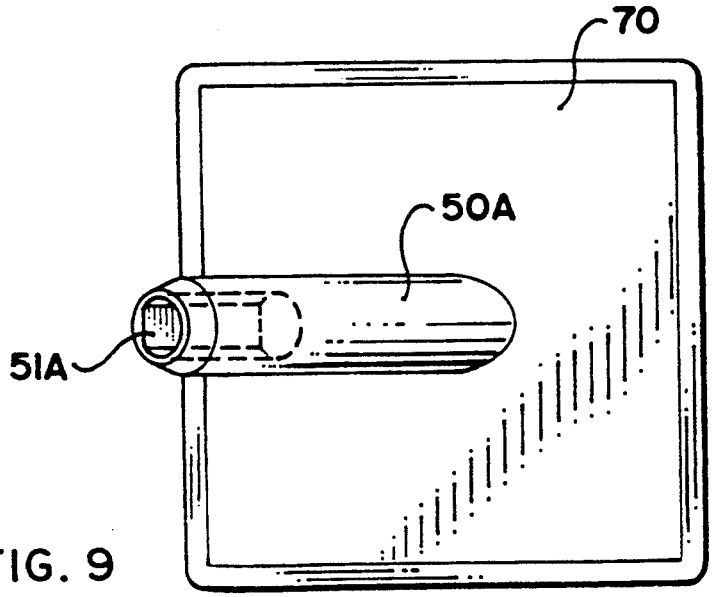
FIG. 9 is an underside view of a tray for the rack of FIG. 1.

In FIGS. 9 and 10 is shown an alternative type of support of the type indicated at 13 including a flat rectangular tray 70 with an up-turned peripheral rim 71. The tray is mounted on a stub shaft 50A substantially equivalent in shape to the stub shaft 50 and including a recess 51A for cooperation with a pin as previously described.

When the post including the support pieces is thus assembled, the user can select the position of the different support elements 12 and 13 and position them on the pins as selected to provide a required amount of support elements for the rack depending upon the use intended. Other types of support elements can also be used as required of different designs as suitable. The tray element 13 and the trouser bar 12 enables clothes and other articles to be supported on the rack in a neat and attractive manner making them readily available for use at a later time.

The support rack is thus ideally suited for bedrooms of the average home where space is often at a premium or for use in hotel rooms. Those pins which are not used by a tray or trouser bar can be covered by a rounded cap for an attractive appearance and to reduce danger of injury on sharp edges.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A support rack for temporary storage of clothes and other articles within a room comprising;

(a) a post member having an upper ceiling abutment pad member for engaging a ceiling of the room, a lower floor abutment member for engaging the floor, spring means between the post member and the upper pad member so as to bias the upper pad member into engagement with the ceiling for support of the post member solely by engagement with the ceiling and the floor; and said post member further comprising a plurality of support pieces each separately and integrally injection molded from plastic material, each of said support pieces having an upper coupling portion, a lower coupling portion, and a plurality of pins inclined upwardly and outwardly thereon;

said post member further comprising a plurality of elongate post portions having ends; and whereby each of said upper coupling portion and lower coupling portion of each of said support pieces is connected to a respective end of each of said post portions in an axially aligned position to define said post member such that said support pieces are spaced by at least one of said post portions;

(b) a plurality of support members removably mounted on the post member for engaging and supporting clothing and other articles, each of said support members having a sleeve thereon which slides over each of said pins for ready removal and attachment of the support member to the post member, and each of said plurality of pins having a longitudinally extending flat surface for preventing rotation of the sleeve about an axis of the pin; and at least one of said support members is a trouser bar which includes a stub shaft portion defining said sleeve receiving said pin of said post member and a triangular loop portion attached to an end of said stub shaft portion such that said triangular loop portion lies substantially in a horizontal plane which is at right angles to a vertical plane containing the stub shaft portion; and at least one of said support members is a tray which include a stub shaft portion defining said sleeve receiving said pin of said post member and a horizontal tray portion attached to an upper end of said stub shaft portion of said tray.

2. The support rack according to claim 1 wherein the ceiling abutment pad member comprises a cylindrical sleeve portion, an uppermost frusto-conical portion diverging outwardly from an upper end of the cylindrical sleeve portion, a flat top plate of the frusto-conical portion having a central hole therethrough.

3. The support rack according to claim 2 including a resilient pad attached to the flat top plate.

4. The support rack according to claim 1 wherein the lower floor abutment member comprises a sleeve portion having a flared lower end diverging outwardly to a lowermost rim, an end face of the floor abutment member at the rim being open.

5. The support rack according to claim 4 including openings around the rim for receiving screws allowing the floor abutment member to be screw fastened to a floor surface.

* * * * *